United States Patent [19]

Patry

[11] 4,037,372

[45] July 26, 1977

[54] ROOF FACIA ARRANGEMENT

[75] Inventor: Francis Joseph Patry, Lewiston, Maine

[73] Assignee: Johns-Manville Corporation, Denver, Colo.

[21] Appl. No.: 584,809

[22] Filed: June 9, 1975

[51] Int. Cl.[2] ..... E04D 13/14; E04D 5/14; E04D 3/36

[52] U.S. Cl. ..... 52/96; 248/214; 52/573; 52/717

[58] Field of Search ..... 52/60, 61, 94, 96, 573, 52/716–718; 403/393, 292, 298

[56] References Cited

U.S. PATENT DOCUMENTS

| | | | |
|---|---|---|---|
| 3,365,847 | 1/1968 | Josek | 52/94 |
| 3,444,658 | 5/1969 | Gobel | 52/94 |
| 3,624,973 | 12/1971 | Attaway | 52/60 |
| 3,668,811 | 6/1972 | Pollard | 52/96 |
| 3,735,540 | 5/1973 | Thaler | 52/94 |

FOREIGN PATENT DOCUMENTS

| | | | |
|---|---|---|---|
| 1,659,338 | 1/1971 | Germany | 52/96 |

OTHER PUBLICATIONS

Sweets Catalogue, vol. 3, 1972, Section 7.2 Si, pp. 2 and 3.

*Primary Examiner*—Price C. Faw, Jr.
*Assistant Examiner*—James L. Ridgill, Jr.
*Attorney, Agent, or Firm*—Robert M. Krone; Joseph J. Kelly; Stephen C. Shear

[57] ABSTRACT

A roof facia arrangement comprising part of an overall facia system is disclosed herein. The arrangement includes a facia receiver which is adapted to rest in a self-aligning fashion against adjoining top and side surfaces at the top edge portion of a building and a facia cover plate which is adapted to interlock with the facia receiver in a horizontally free-floating and moisture sealing fashion. The arrangement also includes a flashing membrane which is adapted to cooperate with the facia receiver and facia cover plate to provide an effective moisture seal at the top edge of the building and which is not pierced or otherwise damaged by fastening elements used in assembling the roof facia arrangement.

16 Claims, 7 Drawing Figures

28'
6
10
114
6

126
116
60'
34'
30'
114
32'
108
34
110
112
120
124
102
16
122
10
123
118
130
128

32'
126
100
30
106
60'
116
104
122
34'
120
110
108
112
102
114
122
124
130
128
123
118

ROOF FACIA ARRANGEMENT

BACKGROUND OF THE INVENTION

The present invention relates generally to facia systems for building roofs and more particularly to an uncomplicated roof facia arrangement designed for reliability in construction, ease in assembly and durability in use.

Facia systems, which are used in large part in conjunction with built-up roof decks, are intended to serve one of two primary functions, or both. First, they are to act as a water dam surrounding the outer periphery of the built-up roof deck, thereby preventing water from running off the top and down the sides of the building. Second, they are to provide an aesthetically appealing finishing trim around the top of the building, i.e., around the built-up roof deck. Facia systems may, of course, serve other functions such as, for example, to provide a moisture seal at the outer edges of the building where the built-up roof deck ends, thereby preventing water or other such moisture from seeping in under the built-up roof.

There are many different types of facia systems available and/or generally disclosed in the prior art. Some of these systems are very simple in design and accordingly are, in most cases, relatively inexpensive to manufacture and rather easily assembled in the field. However, these less complicated systems do suffer in the area of reliability and durability. On the other hand, there are those systems which more reliably serve to prevent water run-off and/or more durably remain in place after assembly to provide a longer lasting, well aligned finishing trim. These latter systems, however, are generally more complicated in design than the simpler systems and, as a result, are generally more expensive to manufacture and much more difficult to assemble in the field.

As will be seen hereinafter, the present invention provides a facia arrangement which, in the overall system, provides the advantages of both the heretofore suggested less complicated and heretofore more complicated facia systems. The facia arrangement constructed in accordance with the present invention is uncomplicated in design, economically manufactured and easily assembled in the field, and yet it functions as a water dam, aesthetically appealing finish trim and moisture seal in a reliable and durable fashion.

BRIEF SUMMARY OF THE INVENTION

An object of the present invention is to provide a roof facia arrangement which is uncomplicated in design, economically manufactured and readily assembled in the field.

Another object of the present invention is to provide a facia arrangement which, in a reliable and durable manner, serves as a water dam, aesthetically pleasing finishing trim and moisture seal along an edge section of a built-up roof.

Still another object of the present invention is to provide a roof facia arrangement which, as a unit, compensates for both expansion and contraction of its individual components as a result of changes in temperature, to minimize the possibility of damage to the arrangement otherwise resulting from such expansion and/or contraction.

The foregoing objects, as well as other objects and features to become apparent hereinafter, are achieved by a roof facia arrangement constructed in accordance with the present invention. This arrangement includes a facia receiver which is adapted to rest against and be connected with adjoining top and side surface portions of a building, the receiver, along with other functions, serving as a water dam, and a facia cover plate adapted to rest against or otherwise be positioned in front of the facia receiver to serve various functions, one of which is to hide the receiver from view. The roof facia arrangement may also include a flashing membrane to be partially held in place between the facia receiver and facia cover plate in providing an effective moisture seal at the edge of the building.

In accordance with one feature of the present invention, the facia receiver is rigidly fastened to the building and the facia cover plate is interlocked with the receiver, however, in a horizontally (longitudinally) "free-floating" fashion. More specifically, the cover plate, when interlocked with the receiver, is restrained from moving away from or in a vertical direction relative to the receiver and yet is free to move in a horizontal (longitudinal) direction with respect to the receiver. This is accomplished without piercing through the cover plate with nails or other such means. Accordingly, the facia plate can expand or contract horizontally (longitudinally) as a result of temperature changes without placing much, if any, stress on the facia receiver, which stress might otherwise (1) loosen the connection between the receiver and the building, (2) cause damage to the receiver generally and/or (3) create misalignment of the overall facia arrangement. Moreover, by eliminating nails or other such piercing type fastening means associated with the cover plate, the possibility of leakage through loosened fastening means resulting from expansion and contraction of the cover plate is eliminated. Further, because the cover plate is free floating, it is not necessary to design it to expand and contract synchronously with the receiver (even if this were possible). Hence, the cover plate can be made of a different material than the receiver, having a different coefficient of thermal expansion, and can be of a different temperature than the receiver (which would generally be the case). In other words, the cover plate is not required to expand and contract in synchronism since the cover plate is "free floating."

In accordance with another feature of the present invention, the facia receiver and facia cover plate are constructed so that the flashing membrane, which preferably also comprises part of the facia arrangement, is not fastened to either the receiver or cover plate or, for that matter, the built-up roof and is substantially unaffected by horizontal expansion or contraction of the cover plate or receiver. In other words, in accordance with the instant invention, it is not necessary to hold the flashing membrane in place either against the built-up roof or the other components of the facia arrangement by means of nails or other similar means and the flashing membrane nevertheless remains in place, even during horizontal expansion or contraction of the facia cover plate or receiver. These features of the membrane minimize if not completely eliminate the possibility of damage to the membrane otherwise resulting from (1) stress applied to the membrane generally due to the expansion and/or contraction of the other components of the facia arrangement and particularly the facia cover plate, (2) stress applied to the membrane at the heretofore used fastening points, i.e., the nail points, and/or (3) general rusting of the nails or similar fastening means heretofore used to attach the membrane, the rusted nails providing a passageway for moisture.

In accordance with still another feature of the present invention, the facia receiver is constructed so as to be self-aligning when assembled to the adjoining top and side surfaces of the building. More specifically, heretofore, the roofer or other such individual was often required to make a "chalk line" on the building roof against which the facia system was aligned. This not only requires additional time but also requires that the facia system be immediately assembled to the building before the chalk line is washed away or otherwise removed. In addition, the roofer was often required to manually align the facia system with the chalk line which, if done carefully, adds additional time to assembly and, if not done carefully, creates misalignment problems and/or results in an uneven appearance.

The facia receiver constructed in accordance with the instant invention includes a first main section adapted to rest against the side surface of the building and a second transverse section located above the main section and adapted to rest against the top surface of the building. The main section is connected with the transverse section in a sufficiently rigid manner (but not necessarily requiring extremely rigid material) so that the two sections together define a substantially fixed angle equal to the angle at which the top and side surfaces of the building meet. The angle at which the main and transverse sections of the receiver meet is designed to provide automatically the desired alignment of the receiver against the building. The roofer is not required to make a chalk line and does not require a large amount of time to assemble the receiver to the building. The facia receiver also includes a top section which remains substantially fixed angularly with respect to the transverse section, again, without necessarily requiring extremely rigid material. Hence, the top section is automatically aligned with the building.

The aforediscussed features of the roof facia arrangement constructed in accordance with the present invention provide an arrangement which is uncomplicated in design, economically manufactured, readily assembled in the field and both reliable and durable in use. In addition, other features of this arrangement will become apparent hereinafter as the arrangement is discussed in more detail.

DETAILED DESCRIPTION AND PREFERRED EMBODIMENTS

Figure 1:
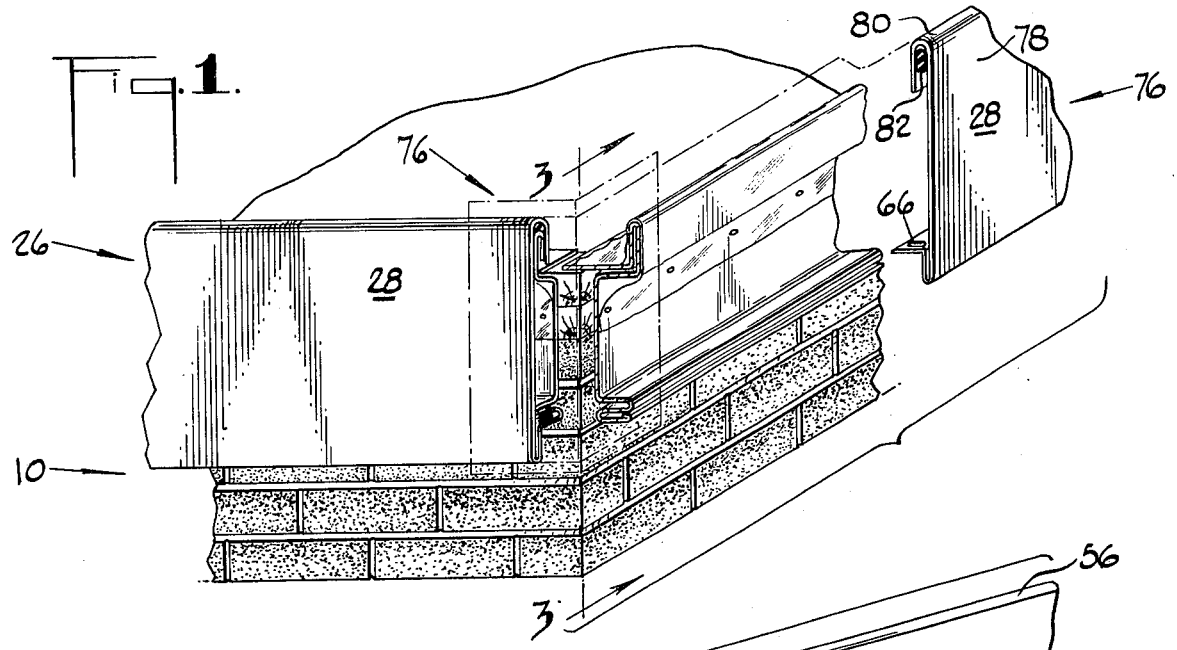
FIG. 1 is a broken-away perspective view of the top corner of a building including a built-up roof and a facia system constructed in accordance with one embodiment of the present invention.
Figure 3:
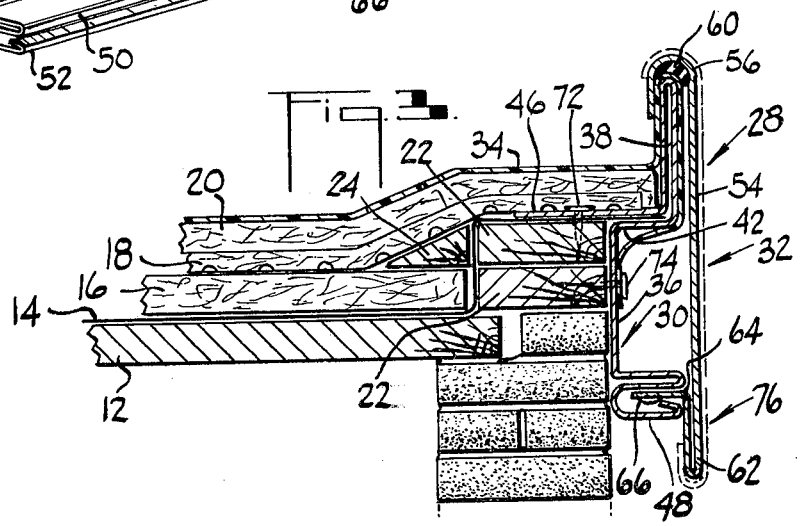
FIG. 3 is a vertical sectional view taken generally along line 3—3 in FIG. 1, showing the roof facia arrangement of FIG. 2 assembled against a top edge portion of the building of FIG. 1.

Turning now to the drawings, wherein like components are designated by like reference numerals throughout the various figures, the top edge portion of a building 10 is shown in FIGS. 1 and 3 and, as illustrated specifically in FIG. 3, the building includes a horizontally extending roof deck 12. The building also includes conventional components located directly on the deck to make up its roof. These components typically include a vapor barrier 14, a layer of insulation 16 such as FESCO board manufactured by Johns-Manville Corporation, a combination ventilating-insulating layer of material 18 such as that sold by Johns-Manville Corporation under the tradename VENTSULATION and a top built-up roof layer 20. These components, as just stated, are conventional and may be readily provided by those with ordinary skill in the art. The top outer periphery of building 10 is preferably built up in a somewhat tapering fashion by means of wooden two-by-four nailers 22 and a wooden cant 24 or other suitable means, as illustrated in FIG. 3.

As illustrated in FIG. 1, an overall facia system 26 is provided around the top periphery of building 10 to serve various functions which have at least partially been discussed hereinabove and which will be further discussed hereinafter. System 26 is comprised of a number of roof facia arrangements 28, one of which is shown in detail in FIG. 2. As shown in this latter figure, arrangement 28, constructed in accordance with one embodiment of the present invention, includes a facia receiver 30, a facia cover plate 32 and a flashing membrane (indicated by dotted lines) 34.

Facia receiver 30 which, as will be discussed hereinafter, is preferably an integrally formed unit, includes a vertically extending, straight main section 36 adapted to rest against and possibly fastened to a side surface of building 10. Located above the top edge of main section 36 is a somewhat inverted U-shaped top section 38 which, for reasons to be apparent below, is spaced forwardly or outwardly of section 36 (see FIG. 3) and which includes a somewhat rounded uppermost horizontally extending surface 40 defining the uppermost edge of the receiver. The forwardmost or outer end of inverted U-shaped top section 38 joins the top edge of main section 36 by means of a transverse connecting section 42. As will be seen hereinafter, top section 38, which may include a plurality of ventilation openings 44 extending through one or both of its sides, is adapted to extend above the top edge of building 10, as seen best in FIG. 3.

A second transverse section 46 joins the inward or rearward end of top section 38 and extends inwardly or rearwardly of main section 36, preferably parallel to and spaced slightly above connecting section 42. Section 46, most of which is adapted to rest against the top surface of building 10, and main section 36 together define an angle $\alpha$ which in most cases will be 90° but which in any case is approximately equal to the angle at which the top and side surfaces of building 10 meet.

Because of the manner in which transverse section 46 joins main section 36, i.e., by means of inverted U-shaped top section 38 and transverse connecting section 42, inadvertent changes in angle $\alpha$ during assembly is minimized without the necessity of relying solely on heavy gauged or otherwise highly rigid material in constructing the facia receiver. More specifically, by providing a not too thin material and yet not too thick and costly material in forming the receiver and by forming the receiver in the manner shown, the angle $\alpha$ remains substantially fixed, when the receiver is assembled to building 10 in the manner to be discussed. The material making up the receiver should be somewhat flexible so as to conform with slightly uneven surfaces and, because of economy, is preferably somewhat flexible galvanized steel. As will be discussed hereinafter, by providing a substantially fixed angle $\alpha$ between the main section of the receiver and transverse section 46, the receiver is self-aligning against building 10 and does not require the utilization of the previously discussed chalk line and does not require a great deal of time in assuring proper alignment of the receiver.

In addition to the foregoing, it should be noted that top section 38 meets transverse section 46 at an angle $\beta$, for example, 90°. Angle $\beta$ defines the way in which the top section extends from the roof and it also remains substantially fixed especially during assembly, even without relying on heavy gauged material. This is because the inverted U-shape maintains angle $\alpha$ fixed more reliably than would be the case if top section 38 were a single unfolded section of the same gauge material. Hence, there is little fear of misalignmentdue to a change in this angle.

In addition to aforediscussed sections 36, 38, 42 and 46, facia receiver 30 includes a bottom interlocking section 48 which extends forwardly or outwardly of main section 36 a distance substantially equal to that of section 42, as best seen in FIG. 3. Interlocking section 48 is comprised of a continuous segment having one end directly joined with the bottom end of main section 36 and bending back on itself a sufficient number of times, for example, twice, so as to define a horizontally extending forward or outwardly facing opening 50 which allows access into and between two adjacent bends in the segment. The otherwise free end of this continuous segment bends into opening 50, as indicated as 52. As will be seen hereinafter, section 48 is adapted to be readily interlocked with a corresponding interlocking section comprising part of facia cover plate 32 such that the latter is restrained from moving vertically with respect to or away from the receiver but which is free to move in a horizontal direction with respect to the receiver.

As stated above, facia receiver 30 is preferably formed as an integral unit. The receiver may be constructed of any suitable material but is preferably constructed of relatively thin galvanized steel and is preferably roll formed into the shape discussed. In an actual working embodiment, the receiver is approximately six inches high (from top to bottom) and for ease of handling is approximately ten feet long (its horizontal length) and is constructed of 24 or 26 gauge galvanized steel. Note again that it is not necessary to construct the receiver of an expensive, heavy gauge or other such rigid material to provide the aforediscussed substantially fixed angles $\alpha$ and $\beta$ to achieve self-alignment.

Having described facia receiver 30, attention is now directed to facia cover plate 32 which includes a vertically extending, substantially straight, main section 54. This section, which is approximately equal in height to that of the entire receiver 30, is adapted for positioning in front of the receiver to hide the latter from view and thereby furnishing an aesthetically pleasing view of the facia arrangement from the street. The top end of section 54 is turned rearwardly back on itself so as to define a somewhat inverted U-shaped top section 56 which provides a horizontally extending, inverted U-shaped opening 58 located behind and at the top of main section 54. As will be seen hereinafter, with facia arrangement 28 assembled, top section 56 fits over and around the uppermost edge 40 of facia receiver 30.

Figure 2:
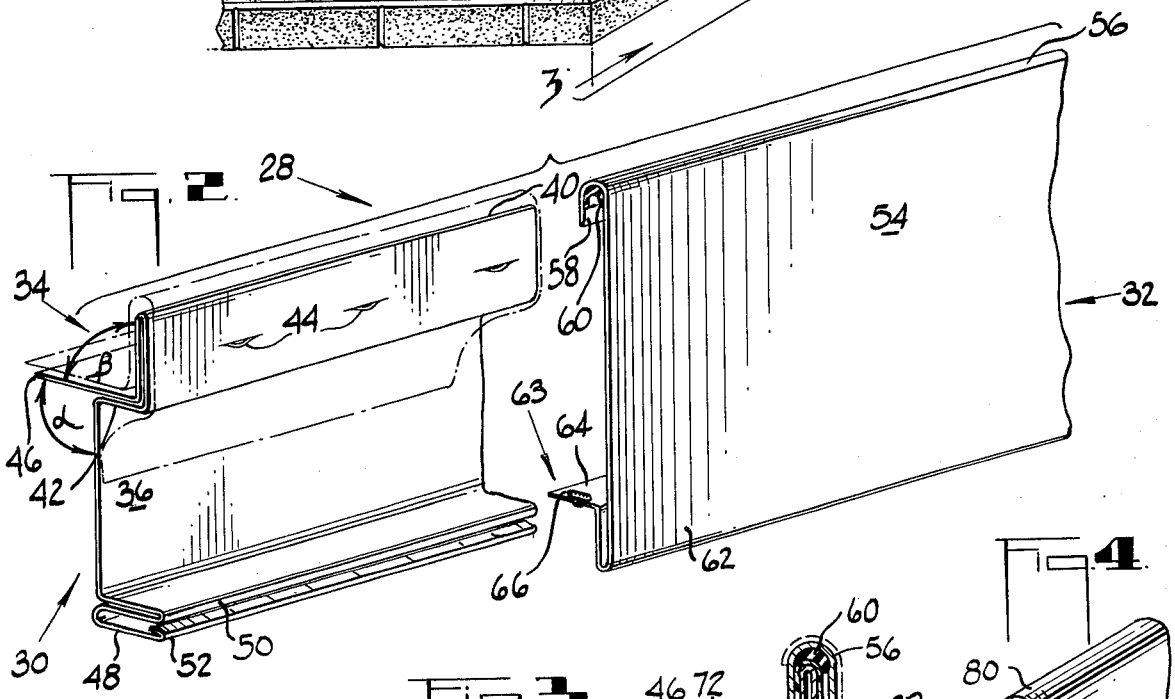
FIG. 2 is a broken-away perspective view of the unassembled components of a roof facia arrangement which is constructed in accordance with one embodiment of the present invention and which comprises part of the facia system of FIG. 1.

As seen in both FIGS. 2 and 3, a resilient mositure sealing member 60 is located within the opening 58 of inverted U-shaped top section 56. Member 60, which extends the length of opening 58, i.e., the length of the facia cover plate, preferably extends around the internal surface of top section 56 and, hence, displays a somewhat inverted U-shape. The sealing member is preferably fastened to the internal surface of top section 56 by means of, for example, suitable adhesive. As will be seen hereinafter, with arrangement 28 assembled, sealing member 60 lies between the uppermost edge of receiver 30 and top section 56 of cover plate 32, actually against a horizontally extending portion of flashing membrane 34 which is positioned over the uppermost edge of the receiver prior to assembly of the cover plate. The sealing member should be constructed of a sufficiently resilient material for providing a moisture seal and yet it should also be sufficiently resilient and sufficinetly thick to allow at least a small degree of horizontal movement of the cover plate, for example, movement due to expansion and contraction of the cover plate, without such movement causing similar movement of the flashing membrane and without applying much if any stress on the flashing membrane or facia receiver. The sealing member is preferably constructed of foam elastomer, for example, foam rubber having a density of between approximately2.5 and 4 lbs./cu. ft.

As illustrated in FIGS. 2 and 3, the bottom of main section 54 of cover plate 32 also turns rearwardly upon itself so as to define a bottom somewhat U-shaped section 62. In addition to this section, sections 54 and 56 and sealing member 60, cover plate 32 includes an interlocking segment 63 including a transverse section 64 which joins the otherwise free end of bottom section 62 and which extends rearwardly or internally therefrom at an angle of approximately 90°. Interlocking segment 63 also includes a plurality of horizontally spaced ribs 66 press formed into section 64 and depending from the downwardly facing surface of section 64. As will be seen hereinafter, interlocking segment 64 is inserted into opening 50 of interlocking section 48 directly over the turned-in end 52 of the latter. This requires a slight degree of exertion since the width of opening 50 is somewhat less than the combined width of section 64 and depending ribs 66. However, the bottom two turns of interlocking section 48 will spread apart to receive interlocking segment 63 and once ribs 66 pass beyond turned-in end 52, the bottom two turns of section 48 will snap back to their initial position causing turned-in end 52 to engage against the sides of the ribs. Hence, interlocking segment 63 and actually the entire lower end of facia cover plate 32 is prevented from moving vertically and away from receiver 30 but is free to move horizontally.

Facia cover plate 32, with the exception of sealing member 60 and possibly depending ribs 66, is also preferably roll formed into an integral unit and constructed of a relatively thin aluminum or galvanized steel. While depending ribs 66 are preferably provided as described, they could be separate components suitably attached to the bottom of section 64 or a single rib could be integrally formed, for example, by turning under the free end of the latter. In an actual working embodiment, sections 54, 56, 62 and 64 of cover plate 32 are constructed of 0.040 gauge aluminum, the cover plate also being approximately ten foot long (in the horizontal direction) and variable in the vertical direction.

As stated previously, roof facia arrangement 28 may also include a flashing membrane 34. This membrane may comprise one or more sheets of moisture impervious material which are preferably sufficiently elastic so as not to crack or craze in cold weather or as a result of minimal stress applied thereto. The membrane should be sufficiently long and sufficiently wide so as to be positioned in the manner to be discussed with respect to FIG. 3. In an actual working embodiment, flashing membrane 34 is comprised of an elastomeric sheet having a self-sticking adhesive on its bottom surface.

Having described roof facia arrangement 28, attention is now directed to the manner in which it is preferably assembled to building 10. The first step is to fasten facia receiver 30 to building 10. This can be done either before or after applying vapor barrier 14 and insulation 16 to deck 12 since both extend only to the wooden nailers 22. Main section 36 of the receiver is rested against the side of the building, as illustrated in FIG. 3, while transverse section 46 is engaged over the top surface of nailers 22. As stated previously, the angle $\alpha$ between these two sections of the receiver has been predesigned to be approximately equal to the angle at which these two surfaces of the building meet, i.e., 90° in FIG. 3. As also stated previously, the angle $\alpha$ is substantially fixed, Hence, transverse receiver section 46 automatically extends the predesigned distance in from the edge of building 10, main section 36 automatically extends down the side of the building the predesigned distance and the top section 38 and bottom interlocking section 48 are automatically located in the predesigned positions shown in FIG. 3. Once positioned, the transverse section 46 of receiver 30 is fastened against nailers 22 by suitable means such as nails 72 which in turn hold the entire receiver in place. Thereafter, the remaining components, i.e., ventilating layer 18 and built-up roof 20 may be provided.

Receiver 30 and particularly top section 38, once assembled, serves to define the outermost periphery against which the roofer may apply the built-up roof and also prevents drippage of the built-up roof material down the sides of the building. This is contrary to many previous facia systems which are assembled after the built-up roof has been provided. Also, it should be noted that it is not necessary and, in fact, it is not desirable to nail through the roofing components and particularly the built-up roof when fastening the receiver to building 10. It should be further noted that the aforediscussed ventilating openings 44 provided through one or both of the sides of top section 38 provide an escape for vapors or other moisture and general ventilation of the roofing components through the two-by-four nailers and thereafter through the openings.

Having rigidly fastened receiver 30 to building 10 in the manner discussed, the next step is to lay down flashing membrane 34. As illutrated in FIG. 3, the membrane is positioned over the built-up roof, directly above transverse section 46 of the receiver and extends up one side of top section 38 of the receiver over the top edge 40 and thereafter down the opposite side of the top section. It may be allowed to float free at its bottom end or, as illustrated in FIG. 3, it may be attached at this end to main section 36 by any suitable means such as nails 74. As stated previously, the underside of the membrane preferably includes an adhesvie so that it can be readily adhered in the manner shown. In this regard, it is not necessary that the membrane be positioned directly over built-up roof 20 but could, in fact, be layed down directly over nailed section 46 of the receiver or between the ventilating layer 18 and built-up roof 20. In any event, it should be noted, for reasons discussed previously, that the flashing membrane is not attached by nails or other similar means other than possible nails 74. However, at the points at which nails 74 attach the membrane, the membrane is not under stress and, even if nails 74 were to rust out or the membrane were to tear around the nails this would have no adverse effect upon the facia arrangement.

Once the flashing membrane is layed down in place, the final step is assembling arrangement 28 is to interlock facia cover plate 32 to the receiver 30. This is accomplished by first fitting inverted U-shaped top section 56 of receiver 32 and sealing member 60 around and against the top edge 40 of receiver 30 and that portion of the membrane located directly over the top edge. Thereafter, the bottom of cover plate 32 is swung down so that interlocking segment 63 enters into opening 50 of interlocking section 48 of the receiver.

With the cover plate in place as illustrated in FIG. 3, it should be noted that it is restrained from moving vertically relative to the receiver and is also restrained from moving away from the receiver. However, as discussed previously, the cover plate is not restrained from moving horizontally (longitudinally) with respect to the receiver. In this regard, even though the sealing member 60 engages against the top edge of the receiver and portion of the membrane located therebetween, the sealing member should be sufficiently thick and sufficiently resilient to provide at least a small amount of give in the horizontal direction, i.e., a sufficient amount of give equal to the degree of horizontal expansion and contraction of the cover plate. Hence, should the cover plate expand, for example, 0.25 inches, this expansion will apply minimal, if any, stress to either the receiver or flashing membrane. In the same manner, should the receiver expand (even though it is nailed down), this expansion will apply minimal, if any, stress to either the cover plate or flashing membrane.

Figure 4:
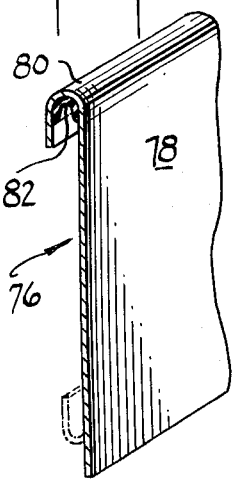
FIG. 4 is a perspective view of a connecting clip comprising part of the system of FIG. 1.

As stated previously, in an actual embodiment, receiver 30 and cover plate 32 are approximately ten feet long. Hence, a number of arrangements 28 are generally required to cover a given side of a building. In order to compensate for the aforediscussed expansion and contraction of cover plate 32, these arrangements making up each side of the building and particularly the common components of these arrangements should be spaced a slight distance from one another, i.e., preferably approximately ½ inch. In this regard, it is desirable to hide this ½ inch spacing which can be provided in any suitable manner. A preferred way of doing this is to use a cover plate 76 shown in FIG. 4. This cover plate is similar to receiver 32 in that it includes a similar main section 78 and a similar inverted U-shaped top section 80 which may include a similar sealing member 82. The bottom of member 76 is initially straight. To cover the spacing between adjacent arrangement 28, member 76, which is sufficiently long to span the spacing, is first attached over adjacent top portions of adjacent receivers 32, spanning the space between the receivers and thereafter the bottom of member 76 is manually turned under the bottom of adjacent portions of segments 62 of adjacent receivers. This is indicated by dotted lines in FIG. 3. In this regard, the same procedure would be followed to close the space where two facia arrangements 28 meet at a corner, as illustrated in FIG. 1, except that member 76 would be appropriately bent to fit the corner. It should be pointed out that cover member 76 should be sufficiently loosely fit with receivers 32 to allow expansion of the latter.

Figure 5:
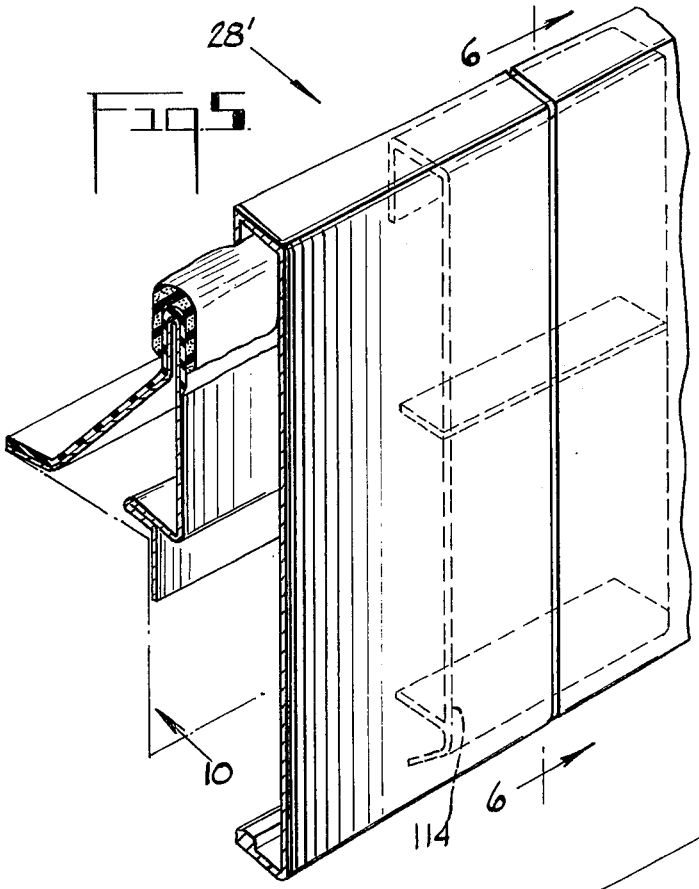
FIG. 5 is a broken-away perspective view of a roof facia arrangement constructed in accordance with another embodiment of the present invention.
Figure 6:
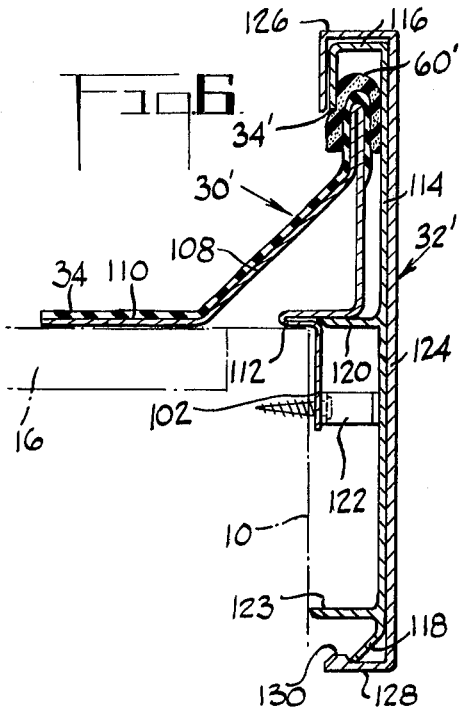
FIG. 6 is a cross-sectional view of the arrangement of FIG. 4 taken generally along line 6—6 in FIG. 5.
Figure 7:
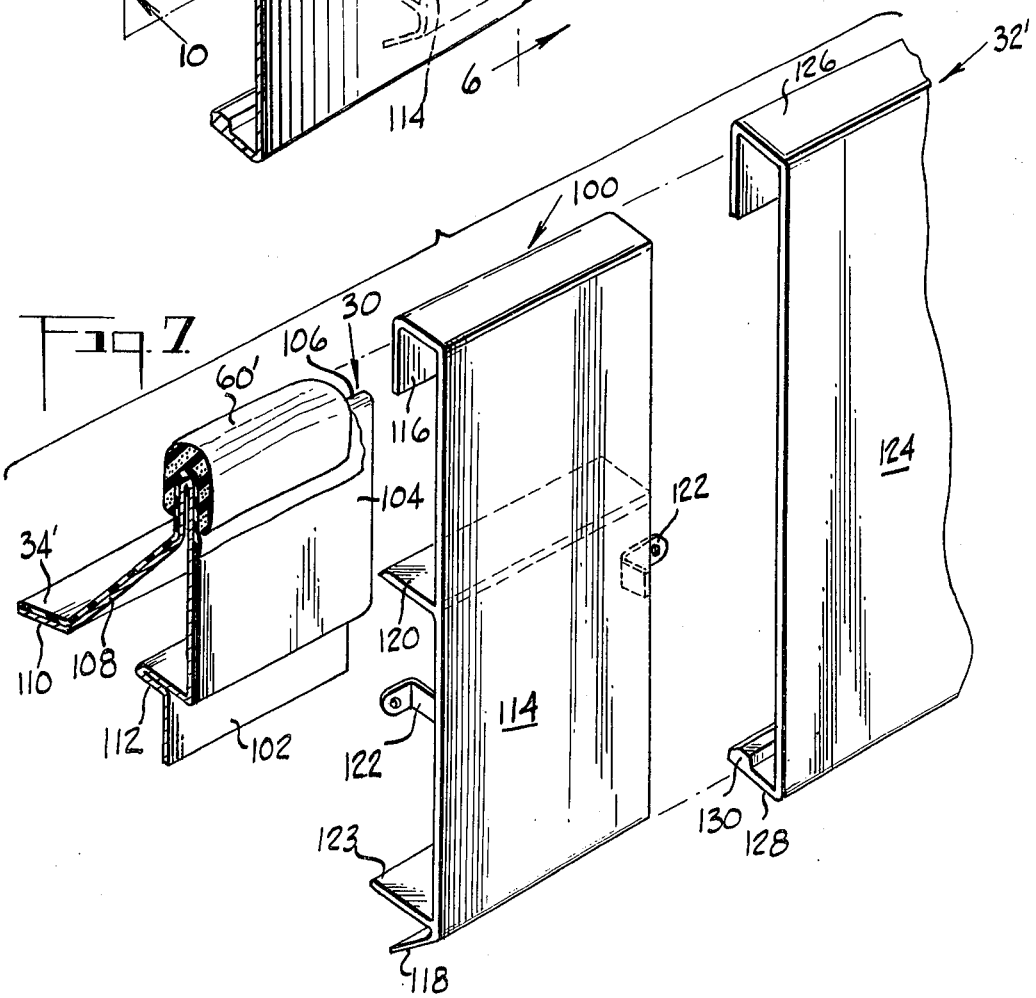
FIG. 7 is a broken-away perspective view of the unassembled components of the roof facia arrangement of FIGS. 5 and 6.

Having described overall facia system 26 including roof facia arrangements 28, attention is now directed to a rooof facia arrangement constructed in accordance with a second and preferred embodiment of the present invention, generally designated by the reference numeral 28' in FIGS. 5 to 7. As will be seen hereinafter, this arrangement has the same advantages as previously described arrangement 28 as well as other advantages over and above that of arrangement 28. Arrangement 28' provides essentially the same function as arrangement 28 and is positioned around the top corners of building 10 (indicated by dotted lines in FIG. 5) in the same manner as previously described arrangement 28. In this regard, the roof deck 12 and various components located over the deck, as illustrated in FIG. 3, have been omitted from FIG. 5 but, of course, would be included as part of the overall building roof structure in FIG. 5.

As best seen in FIGS. 6 and 7, arrangement 28' includes a roof facia receiver 30' and a roof facia cover plate 32'. In addition, this arrangement includes an interlocking intermediate member 100. This arrangement also includes a flashing membrane 34' identical to previously discussed membrane 34 and a moisture seal 60' which could be identical to previously discussed seal 60.

Facia receiver 30' which, like previously described facia receiver 30, is preferably an integral unit, preferably glavanized steel, includes a vertically extending, straight main section 102 adapted to rest against the side surface of building 10. Located above the top edge of main section 102 is a somewhat inverted U-shaped top section 104 which is spaced forwardly or outwardly of section 102. As best seen in FIG. 7, section 104 is turned about itself (providing its inverted U-shape) to define a somewhat rounded uppermost horizontal or longitudinally extending surface 106 defining the uppermost edge of the receiver. Section 104 extends behind its forward face to define an angled surface 108, preferably extending at approximately 45° to the horizontal and a flat horizontal surface 110 adapted to rest against to the roof deck of the building, for example roof deck 12 shown in FIG. 3. The angled surface 108 acts as a cant, thereby eliminating the cant shown in FIG. 3.

The otherwise free end of the front surface of section 104 joins the top edge of section 102 by means of a transverse section 112 which is turned on itself. Like receiver 30, the front face of upper section 104 may include a plurality of ventilation openings (not shown) extending through one or both of its sides.

From the foregoing description of receiver 30', it should be apparent that this receiver is similar in many respects to previously described receiver 30. However, there are some notable differences. First, it should be noted that receiver 30' has a transverse or vertical length which is much shorter than that of receiver 30. More specifically, receiver 30' does not include an interlocking section similar to interlocking section 48 of receiver 30. In this regard, as will be seen hereinafter, member 100 is provided for interlocking facia cover plate 32' with receiver 30'. In addition, receiver 30' itself acts as a water dam and may be referred to as such since, as described, it includes its own cant, i.e., surface 108. Like receiver 30, receiver 30' may be constructed of any suitable material such as aluminum but is preferably constructed of galvanized steel. As seen in FIG. 7, flashing membrane 34' extends over the surfaces 110 and 108 and over the uppermost edge 106 of the receiver. Moisture seal 60' is positioned over the uppermost edge 106 directly over a portion of the flashing membrane. The moisture seal extends longitudinally the length of the receiver.

Member 100, which is preferably constructed of extruded aluminum but which may be of any suitable material, includes a straight main section 114 which is turned about itself (rearwardly) at its top end to define a somewhat inverted U-shaped top section 116. Main section 114 is bent in (rearwardly) at an angle, preferably approximately 45° with the horizontal to define a first interlocking section 118 to be discussed below. Member 100 also includes a second interlocking section 120 (which may comprise one leg of an angled flange) suitably fastened to the back surface of main section 114 intermediate the upper and lower ends of the main section and extending the length of the main section in a horizontal plane.

Member 100 is preferably much shorter longitudinally than receiver 30', for example 4 inches as compared to 10 feet. On the other hand, member 100 is greater vertically than receiver 30'. As seen best in FIG. 6, the main section 114 of member 100 is positioned over the front face of the receiver such that inverted U-shaped section 116 fits tightly over a longitudinal portion of the uppermost edge 106 of the receiver with moisture seal 60' and a portion of flashing membrane 34' therebetween. Interlocking section 120 is located so as to be force fit directly below the front face of main section 104, thereby engaging tightly against a portion of the underside of transverse section 112. In this way, member 100 is held substantially fixed to the receiver.

As best seen in FIG. 6, a portion of main section 114 of member 100 extends below the receiver and is spaced from the side surface of building 10. To further prevent member 100 from moving, the member may include a pair of angled flanges 122 attached to (preferably integrally formed with) main section 114 extending rearwardly of the main section, i.e., towards the surface 102 of the receiver 30'. As best seen in FIG. 7, one leg of each of these flanges extends longitudinally and is positioned to engage against the surface 102 of in a flush manner (see FIG. 6). In this manner, nails or other suitable means can be inserted through the flush flange legs and into the side surface of building 10 as seen in FIG. 6, through surface 102. As also seen in FIG. 6, main Section 114 includes a rearwardly extending reinforcing member which extends the length of Section 114 thru member engages against the side wall of the building during interlocking of SEction 118 with coverplate 32'.

Facia arrangement 28' includes at least two members 100 interconnected with receiver 30' in the manner just described and spaced from one another. In a preferred embodiment, where a plurality of receivers 30' are held in end-to-end relationship against building 10, members 100 are preferably positioned over the adjoining ends of adjacent receivers.

Facia cover plate 32', which is preferably constructed of integral extruded aluminum but which may be constructed of any suitable material is preferably of approximately the same length longitudinally as receiver 30', i.e., much longer than member 100. Cover plate 32' extends vertically an amount approximately equal to or slightly greater than member 100 and includes a main straight section 124. This section is turned about itself (rearwardly) at its top end to define an inverted somewhat U-shaped section 126 which, for reasons to be discussed below, is slightly greater than inverted U-shaped section 116 of member 100. The bottom end of main section 124 is bent back (rearwardly) somewhat perpendicular to itself to define an interlocking section 128 which is beaded at 130. This interlocking section including the bead 130 extends the entire length longitudinally of main section 124.

As best seen in FIGS. 5 and 6, main secton 124 of cover plate 32' is positioned directly in front of receiver 30' and member 100. Inverted U-shaped section 126 is positioned slidably over and around inverted U-shaped section 116 of member 100 and, in the areas where member 100 does not extend, section 126 is positioned directly over moisture seal 60' in a slidable or at least longitudinally movable manner. In this regard, since the moisture seal has a large degree of resiliency, even though section 126 is slightly larger than section 116 of member 100, that portion of section 126 positioned directly over moisture seal 60' is seal engaged by the moisture seal. As illustrated in FIG. 6, the bottom end of main section 124 of the receiver 32' is located slightly below or at least adjacent the lowermost edge of interlocking section 118. In this manner, the bead 130 of interlocking section 128 is force fitted behind the free end of interlocking section 118. This interlock exists only between the cover plate and members 100. Hence, in those areas in front of the receiver where members 100 do not extend, interlocking section 130 is maintained in an unengaged fashion.

Cover plate 32', assembled in the aforedescribed manner, is freely movable in the longitudinal direction, i.e., it is capable of floating freely longitudinally relative to member 100 and receiver 30' so as to compensate for expansion and contraction. However, it is substantially prevented from all other movement where more than one cover plate is provided, as illustrated in FIG. 5, they are positioned in end-to-end relationship, with a gap between to compensate for expansion and contraction. In addition, the cover plates are preferably located so as to meet directly in front of a member 100, as shown in FIG. 5.

Arrangement 28' has all the advantages of previously described arrangement 28. In addition, the facia receiver 30' not only acts as a receiver along with member 100 but also acts as a water dam. Further, because the receiver 30' is substantially shorter vertically than receiver 30 and because it does not have to be connected directly to cover plate 32' along its entire length, cost in manufacturing the overall arrangement and time in assembling the arrangement is saved.

What I claim is:

1. A roof facia arrangement comprising:

a. a longitudinally extending integral facia receiver adapted to fixely rest against adjoining top and side surfaces of a building, said receiver including
   i. a vertical receiver section adapted to rest against the side surface of said building,
   ii. a second receiver section located above and transverse to said first section extening beyond both sides of said first section, a portion of said second section being adapted to rest against the top surface of said building, and
   iii. a vertical third section having an uppermost edge and located above said fist and second sections, said third section being connected with said second section and spaced forwardly of said first section;

b. a longitudinally extending intermediate member substantially shorter longitudinally than said receiver and including
   i. a vertical main section substantially longer vertically than said receiver,
   ii. an inverted U-shaped section located above and extending rearwardly of said main section,
   iii. first interlocking means located below and extending rearwardly of said main section, and
   iv. second interlocking means connected with and extending rearwardly from said main section above said interlocking means and below said inverted U-shaped section;

c. said receiver and intermediate member being connected together such that
   i. said main section of said member is located in front of said receiver,
   ii. said inverted U-shaped section is positioned over the uppermost edge of the third section of said receiver, and
   iii. said section interlocking means engages in force-fitting relationship against a second portion of said second receiver section;

d. a longitudinally extending facia cover plate substantially longer longitudinally than said intermediate member, said cover plate including
   i. a vertical main section,
   ii. an inverted U-shaped section located above and extending rearwardly of said last-mentioned main section, and
   iii. interlocking means located below and extending rearwardly of said last-mentioned main section;

e. said cover plate, receiver and intermediate member being connected to together such that
   i. said main section of said cover plate is located in front of said receiver and intermediate member,
   ii. said inverted U-shaped section of said cover plate is positioned over said inverted U-shaped section of said member and over said uppermost edge of said third receiver section, and
   iii. said interlocking means of said cover plate is interlocked with said first interlocking means of said intermediate member, and
   iv. said cover plate is free to move longitudinally relative to said receiver and intermediate member but held substantially fixed relative to said receiver and member in all other directions;

f. a longitudinally extending moisture seal located between the uppermost edge of said third receiver section and said inverted U-shaped section, said seal being of sufficient resiliency so as not to prevent said free longitudinal movement of said cover plate; and g. a flashing membrane adapted to extend over the top surface of said building and having a longitudinal portion located between the uppermost edge of said third receiver section and said moisture seal.

2. A roof facia arrangement, comprising:

a. a longitudinally extending facia receiver adapted to be fixedly attached to a building so as to rest against adjoining top and side surfaces of said building, said facia receiver including upper and lower sections;

b. a longitudinally extending facia cover plate located in front of said receiver so that the latter is between said cover plate and the side surface of said building, said cover plate including upper and lower sections; and c. an intermediate facia member located between said receiver and said cover plate, said intermediate member being substantially fixedly connected with said receiver and being connected with said cover plate such that such cover plate is freely movable in said longitudinaly direction relative to said receiver and said member but substantially fixed relative to said receiver and member in all other directions;

d. resilient water sealing means;

e. said upper sections of said receiver and plate cooperating with one another so as to allow said upper section of said plate to move longitudinally relative to said receiver;

f. said lower section of said receiver and plate cooperating with one another so as to allow said lower section of said plate to move longitudinally relative to said receiver;

g. said upper and lower sections of said receiver and plate cooperating to prevent substantially all movement of said plate relative to said receiver except said longitudinal movement;

h. said sealing means being located between said upper sections for providing a water seal therebetween, said sealing means being sufficiently resilient to allow a small amount of horizontal movement of said upper section of said plate relative to the upper section of said receiver whereby stress on said facia receiver as a result of horizontal expansion or contraction of said facia plate is minimized;

i. a flashing membrane adapted to extend over the upper section of said receiver between said upper section of said receiver and said sealing means.

3. A roof facia arrangement comprising:

a. a facia receiver adapted to rest against adjoining top and side surfaces of a building, which surfaces join one another at a predetermined angle to define an edge portion of said building, said receiver including i. a first straight receiver section adapted to rest against the sie surface of said building, ii. a second straight receiver section located above said first section and adapted to rest against the top surface of said building, said first section being connected with said second section so that said sections together define an angle equal to said predetermined angle, iii. a top receiver section having an uppermost edge and connected with and located above said first and second receiver sections, and iv. a bottom receiver interlocking section located below and connected with said first receiver section;

b. a facia cover plate including i. a main plate section adapted for positioning in front of the first and top sections of said receiver such that the first and top receiver sections are located between said main plate section and the side surface of said building, ii. a top inverted U-shaped plate section located above and connected with said main plate section, and iii. said facia cover plate including a bottom plate interlocking section connected with said main plate section;

c. resilient moisture sealing means substantially equal in length to the uppermost edge of said top plate section;

d. a flashing membrane;

e. said inverted U-shaped top plate section being adapted to fit over and around the uppermost edge of said top receiver section so as not to prevent horizontal movement of said top plate section relative to the uppermost edge of said top receiver section, whereby to minimize stress on said facia receiver as a result of horizontal expansion or contraction of said facia top plate section;

f. said plate interlocking section being adapted to be interlocked with said receiver interlocking section so as to prevent said interlocking section from moving in a vertical direction relative to one another and away from one another and yet not preventing said interlocking sections from moving in a horizontal direction relative to one another, whereby to minimize stress on said facia receiver as a result of horizontal expansion or contraction of said plate interlocking section;

g. said resilient moisture sealing means adapted to be positioned between the uppermost edge of said top receiver section and said top plate section for providing a moisture seal therebetween and being sufficiently resilient to allow a small amount of horizontal movement of said top plate section relative to the uppermost edge of said top receiver section; and h. said flashing membrane being adapted to cover said second receiver section over the top surface of said building, said membrane being adapted to extend therefrom up one side of said top receiver section, over the uppermost edge of said top receiver section against said sealing means and at least partially down the opposite side of said top receiver section, and membrane being held in place against said sealing means by the upper edge of said top receiver section and said top inverted U-shaped plate section.

4. A roof facia arrangement according to claim 3 wherein said sealing means is connected to and extends the length of the internal surface of said inverted U-shaped top plate section.

5. A roof facia arrangement according to claim 3 wherein a. said receiver interlocking section is comprised of a continuous segment extending forwardly of said first receiver section, said continuous segment having one end connected with the bottom end of said first receiver section and bending back on itself a sufficient number of times to define an opening facing away from the side surface of said building, the other end of said segment bending into said opening, and b. said plate interlocking section including a segment extending transverse of said main plate section, said last mentioned segment being adapted for insertion within said opening and including shoulder means engaging the bent-in end of said receiver interlocking segment after insertion for preventing removal of said plate interlocking segment from within said opening.

6. A roof facia arrangement according to claim 3 wherein said sealing means is substantially equal in length to the uppermost edge of said top plate section.

7. A roof facia arrangement according to claim 3 wherein said first receiver section is connected with said second receiver section in a manner so that said angle defined thereby is substantially fixed.

8. A roof facia arrangement according to claim 7 wherein said angle is approximately 90°.

9. A roof facia arrangement according to claim 7 wherein said top receiver section is an inverted U-shaped section, one end of which connects to one end of said second receiver section and the other end of which connects with one end of the first receiver section.

10. In a building structure having a top surface and adjoining side surfaces, a roof facia arrangement comprising:

a. a longitudinally extending facia receiver adapted to fixedly rest adjacent adjoining portions of said top surface and one of said side surfaces;

b. a flashing membrane adapted to extend over at least a portion of said top surface and having a longitudinal edge portion extending over a longitudinal portion of said facia receiver;

c. a longitudinally extending moisture seal located over and against said longitudinal edge portion of said flashing membrane;

d. a longitudinally extending facia cover plate located over at least a longitudinal segment of said receiver, a longitudinal segment of said cover plate being positioned over and in contact with at least a longitudinal segment of said moisture seal, said cover plate being constructed of a material which expands and contracts in response to changes in its temperature;

e. an intermediate facia member located between said receiver and said cover plate, said intermediate member being substantially fixedly connected with said receiver and being connected with said cover plate such that said cover plate is freely movable in said longitudinal direction relative to said receiver and said member but substantially fixed relative to said receiver and member in all other directions;

f. said cover plate being connected with said receiver and being freely movable in the longitudinal direction relative to said receiver but being substantially fixed in all other directions relative to said receiver; and g. said moisture seal being constructed of a material which is sufficiently resilient and sufficiently thick to allow said cover plate to move freely longitudinally due to expansion or contraction of the cover plate and to substantially prevent said last-mentioned movement from being applied to said membrane and receiver.

11. An arrangement according to claim 10 wherein said membrane is constructed of an elastomeric material.

12. An arrangement according to claim 10 wherein said intermediate member is longitudinally shorter than said receiver and said cover plate.

13. An arrangement according to claim 10 wherein said receiver includes:

i. a first receiver section adapted to rest against said one side surface of said building, ii. a second receiver section located above said first section and adapted to rest against the top surface of said building, and iii. a top receiver section including said longitudinal portion over which said edge portion of said membrane extends, said top section having an uppermost edge and located above said first and second receiver sections.

14. An arrangement according to claim 13 including a second facia cover plate identical to said first mentioned cover plate, said second cover plate being positioned in end-to-end relationship with said first mentioned cover plate, said intermediate member being positioned between said receiver and adjacent end portions of said cover plates and being connected with both of said cover plates so that the latter are freely movable in the longitudinal direction but substantially fixed in all other directions relative to said receiver.

15. An arrangement according to claim 13 wherein said cover plate includes a top inverted U-shaped section which fits over the uppermost edge of said top receiver section, said moisture seal being located between said U-shaped section and said uppermost edge and said flashing membrane extending between said moisture seal and said uppermost edge.

16. In a building structure having a top surface and adjoining side surfaces, a roof facia arrangement comprising:

a. a longitudinally extending facia receiver adapted to fixedly rest adjacent adjoining portions of said top surface and one of said side surfaces;

b. a flashing membrane adapted to extend over at least a portion of said top surface and having a longitudinal edge portion extending over a longitudinal portion of said facia receiver;

c. means located over and against said longitudinal edge portion of said flashing membrane;

d. a longitudinally extending facia cover plate located over at least a longitudinal segment of said receiver, a longitudinal segment of said cover plate being positioned over and in contact with at least a segment of said means, said cover plate being constructed of a material which extends and contracts in response to changes in its temperature;

e. said cover plate being connected with said receiver and being freely movable in the longitudinal direction relative to said receiver but being substantially fixed in all other directions relative to said receiver; and f. said means allowing said cover plate to move freely longitudinally due to expansion or contrasting of the cover plate and substantially preventing said last mentioned movement from being applied to said membrane and receiver.

* * * * *

UNITED STATES PATENT AND TRADEMARK OFFICE

CERTIFICATE OF CORRECTION

PATENT NO. : 4,037,372
DATED : July 26, 1977
INVENTOR(S) : Francis Joseph Patry

It is certified that error appears in the above-identified patent and that said Letters Patent are hereby corrected as shown below:

Column 5, line 28, "misalignmentdue" should read --misalignment due--.

Column 6, line 27, "sufficinetly" should read --sufficiently--.

Column 8, line 66, "arrangement" should read --arrangements--.

Column 9, line 14, "rooof" should read --roof--.

Column 9, line 39, "glavanized" should read --galvanized--.

Column 10, line 48, following "114" insert --and--.

Column 10, line 60, "SEction" should read --Section--.

Column 11, line 18, "secton" should read --section--.

Claim 1-Column 11, line 65, "fixely" should read --fixedly--.

Claim 1-Column 11, line 67, following "vertical" insert --first--.

Claim 1ii-Column 12, line 2, "extening" should read --extending--.

Claim 1iii-Column 12, line 7, "fist" should read --first--.

Claim 1ciii-Column 12, line 31, "section" should read --second--.

Claim 1e-Column 12, line 44, following "connected" delete "to".

UNITED STATES PATENT AND TRADEMARK OFFICE

CERTIFICATE OF CORRECTION

PATENT NO. : 4,037,372

DATED : July 26, 1977

INVENTOR(S) : Francis Joseph Patry

It is certified that error appears in the above-identified patent and that said Letters Patent are hereby corrected as shown below:

Claim 2c-Column 13, line 15, "longitudinaly" should read --longitudinal--.

Claim 3ai-Column 13, line 50, "sie" should read --side--.

Claim 3h-Column 14, line 44, "and" should read --said--.

Claim 9-Column 15, line 17, "the" should read --said--.

Claim 16f-Column 16, line 58, "contrasting" should read --contraction--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*